US005968213A

United States Patent [19]

Tseng

[11] Patent Number: 5,968,213

[45] Date of Patent: Oct. 19, 1999

[54] STRUCTURE OF A FORCEFUL GRINDING MEDIUM

[76] Inventor: Shao Chien Tseng, No.130, Sec. 2, Yang-Shin Rd., Yang-Mei, Taoyuan 326, Taiwan

[21] Appl. No.: 08/988,299

[22] Filed: Dec. 10, 1997

[51] Int. Cl.[6] ..... B24B 31/06

[52] U.S. Cl. ..... 51/293; 51/309; 451/330

[58] Field of Search ..... 51/293, 309; 451/32, 451/330, 326

[56] References Cited

U.S. PATENT DOCUMENTS

| | | | |
|---|---|---|---|
| 1,133,368 | 3/1915 | De Vilbiss | 451/330 |
| 2,978,850 | 4/1961 | Gleszer | 451/330 |
| 4,526,589 | 7/1985 | Ibata | 51/309 |
| 4,736,547 | 4/1988 | Bond et al. | 451/330 |
| 5,281,244 | 1/1994 | Wiand | 51/309 |
| 5,520,712 | 5/1996 | Bizard | 51/293 |
| 5,730,645 | 3/1998 | Park | 451/330 |

*Primary Examiner*—Michael Marcheschi
*Attorney, Agent, or Firm*—Pro-Techtor International Services

[57] ABSTRACT

The structure of a forceful grinding medium comprised of two half-housings engaged with each other, the half-housings both are integrally formed with a plurality of raised circle shaped blades. The raised circle shaped blades improve the three dimensional vibration mode grinding and polishing.

5 Claims, 6 Drawing Sheets

STRUCTURE OF A FORCEFUL GRINDING MEDIUM

BACKGROUND OF THE INVENTION

1. Field of the Invention

The present invention is related to the structure of a forceful grinding medium, and especially to the structure of a grinding medium formed with a plurality of raised and circle shaped blades for obtaining dense and smooth grinding processing areas in a mode of three dimensional vibration grinding, so that grinding efficiency of a lot of such forceful grinding media on a workpiece can be improved. The forceful grinding media which are producible,stainless steel sheets or spring steel sheets can be chosen and heat treated after punch molding to get desired suitable hardness and toughness for use, or they can be formed by sintering in the mode of powder metallurgy to obtain the required hardness and toughness for use.

2. Description of the Prior Art

The technique of three dimensional vibration grinding for polishing workpieces has been very popular and widely used, whereby, grinding granulars are chosen with respect to size, hardness and shape thereof according to the material of a workpiece to be ground and the outlines of the workpiece to be ground and polished. This cooperates with the formulation of the grinding liquid required to have the workpiece processed in a vibration tank of a vibration grinder.

It has been known that the grinding granulars are mixed in the grinding liquid. These grinding media (or grinding granulars) are made of plastic, stones or ceramic material of various hardness, mass and shapes. The selection of the hardness of these grinding media is significantly concerned with the hardness of the workpiece to be ground in the three dimensional collision grinding process with high frequency vibration, in order that the casting of the workpiece can be well polished with the grinding media and produce a workpiece with the desired brightness and smoothness. Furthermore, the unit volume and quantity of the grinding media must be in a certain mutually balanced proportion to the workpiece to be ground, such that the disturbance collision efficiency between the grinding media and the workpiece can be accurately controlled. In addition, the size and shape of the grinding media must be properly chosen in accordance with the shapes of the minimum grooves, ribs or holes on the workpiece to be ground in order to facilitate turning over and collision thereof on the grooves, ribs or holes. Elements such as the cutting angle that may be induced in the grinding tank, the vibration frequency, orientation as well as the disturbance feature of the grinding liquid etc. are also the important factors deciding the effeciency and quality of the vibrational grinding.

However, conventional techniques of vibrational grinding in the art can only be effective on the softer alloy workpieces to be ground. The reason that it is inferior in accuracy and efficiency of grinding on the harder alloy workpieces such as stainless steel, titanium alloy, chromium and molybdenum alloy, etc. is that, when in grinding by the conventional techniques, only plastic, stones or ceramic material etc. are used as the grinding media.

Moreover, conventional grinding media physically are less efficient in grinding and cutting. Area distribution of the processing cutters for smooth grinding and cutting on the surfaces thereof is very limited. The limited number of the cutters is not good for the efficiency of three dimensional collision grinding and cutting.

SUMMARY OF THE INVENTION

In view of this, the conventional techniques are hard to grind and polish the less workable alloy workpieces with higher hardness. Such a problem is exactly the one which the structure of the forceful grinding medium of the present invention is to overcome.

The primary object of the present invention is to select suitable grinding and cutting material coincident with the quality and hardness of the workpiece to be ground, and to make an assemblable structure of grinding medium which is contoured to suit the grinding conditions.

Directing to this object, the present invention is characterized in that:

1. The grinding medium has circular raised blades integrally formed on each medium structure. This is beneficial to soft grinding and cutting operation in a smooth curve on the surfaces of a workpiece in the mode of three dimensional vibration and turning over during collision grinding and cutting.

2. All the circle shaped blades are integrally formed with the housing of the medium structure and are very thin (about 0.3 to 0.5 mm). They have excellent toughness, so that when they collide with the surface of the workpiece, grinding and cutting with delicacy and high quality can be obtained.

3. Distribution of the circle shaped blades integrally formed with the housing can be made to have a certain density according to the requirement of coordination between the curvature of the housing and the shapes of the surfaces of the workpiece to be ground.

4. A mode of using two half-housings to form an assembled round medium structure with a smooth curve is taken to facilitate grinding and cutting operation in the mode of three dimensional vibration and turning-over.

5. A counterweight can be placed in the medium structure in accordance with the specific gravity of the workpiece to be ground. This can increase the efficiency of grinding and cutting and the energy of collision grinding and cutting.

The present invention will be more apparent after reading the detailed description of the preferred embodiments thereof in reference to the accompanying drawings.

DETAILED DESCRIPTION OF THE PREFERRED EMBODIMENT

Figure 1:
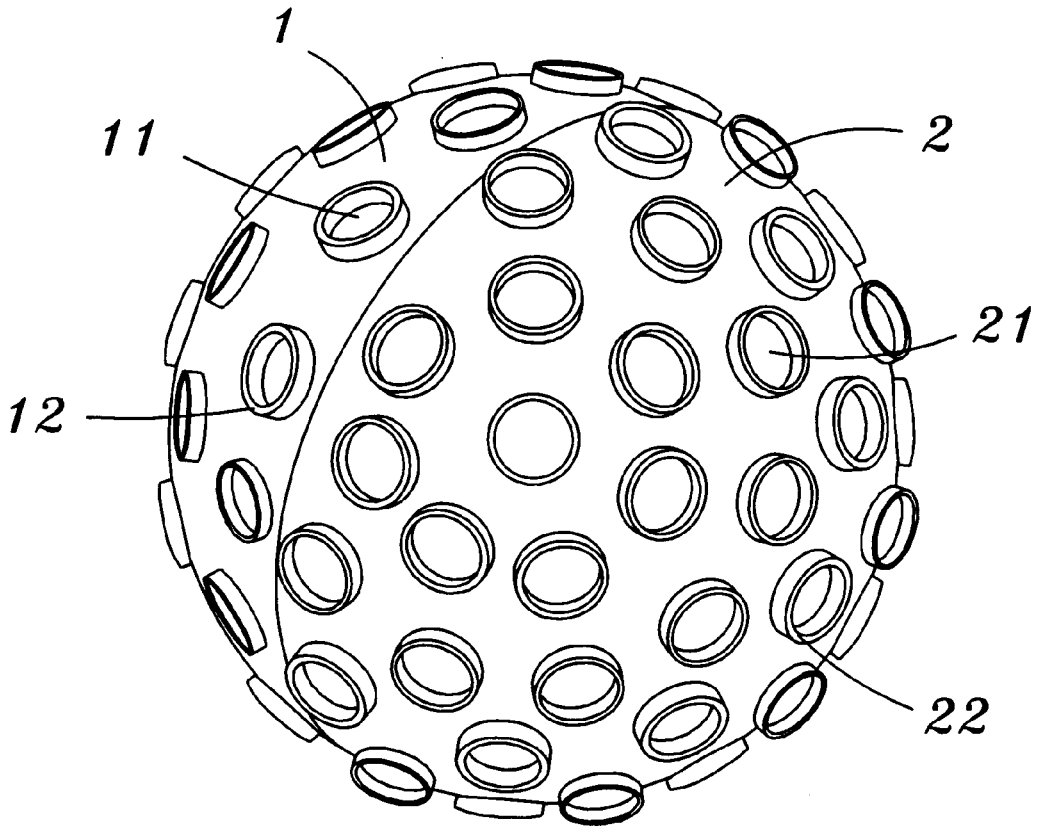
FIG. 1 is a perspective view of the structure of a medium of the present invention.
Figure 2:
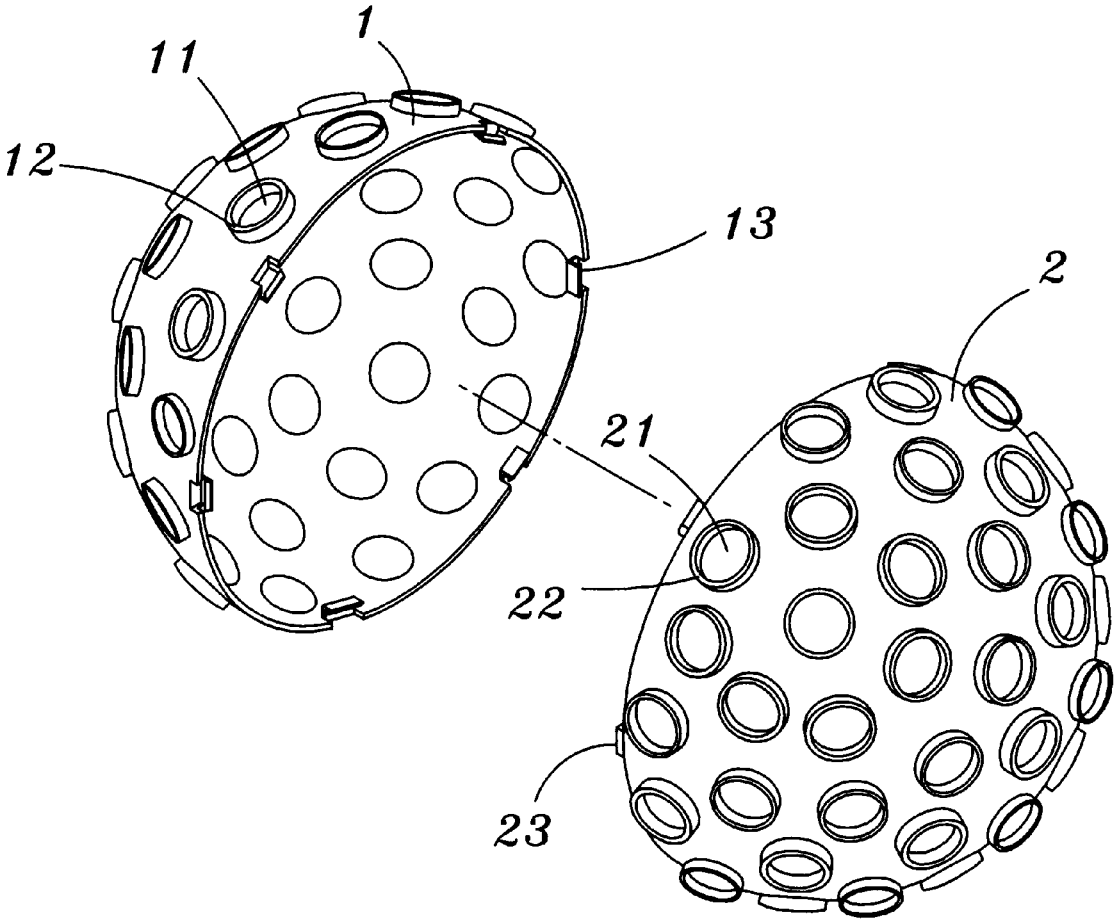
FIG. 2 is an analytic perspective view of the medium structure of the present invention.
Figure 3:
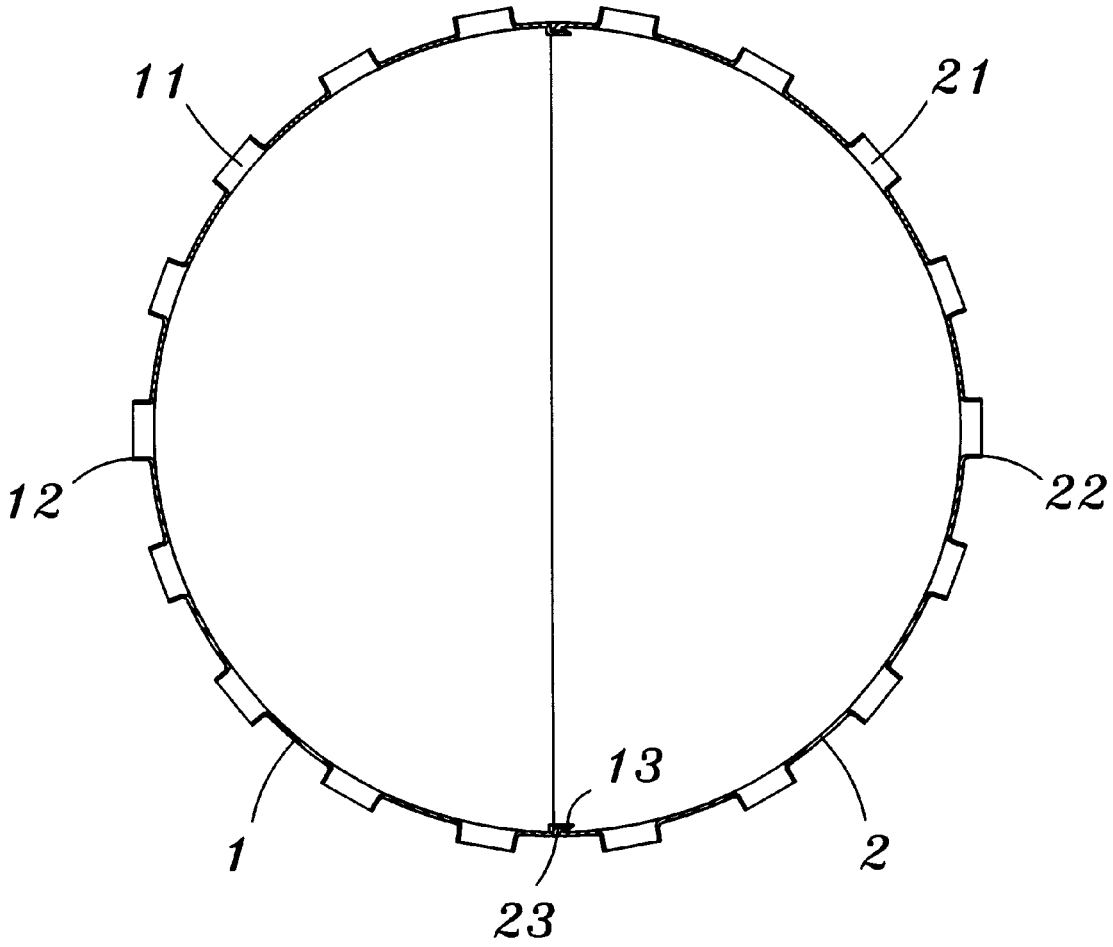
FIG. 3 is a sectional view of the present invention.

Referring to FIG. 1, the structure of a forceful grinding medium of the present invention is comprised of two half-housings 1 and 2 which are engaged with each other. These two half-housings 1 and 2 are integrally formed with a plurality of circle shaped blades 12, 22 of which the centers form a plurality of through holes 11, 21 (such as is shown in FIG. 2) to be communicated with the interior of the half-housings 1 and 2. The half-housings 1 and 2 have their connecting ends provided with the same amount of mortises 13 and tenons 23 opposite to each other, so that the half-housings 1 and 2 can be press assembled easily to form the medium structure (as shown in FIG. 3).

Figure 4:
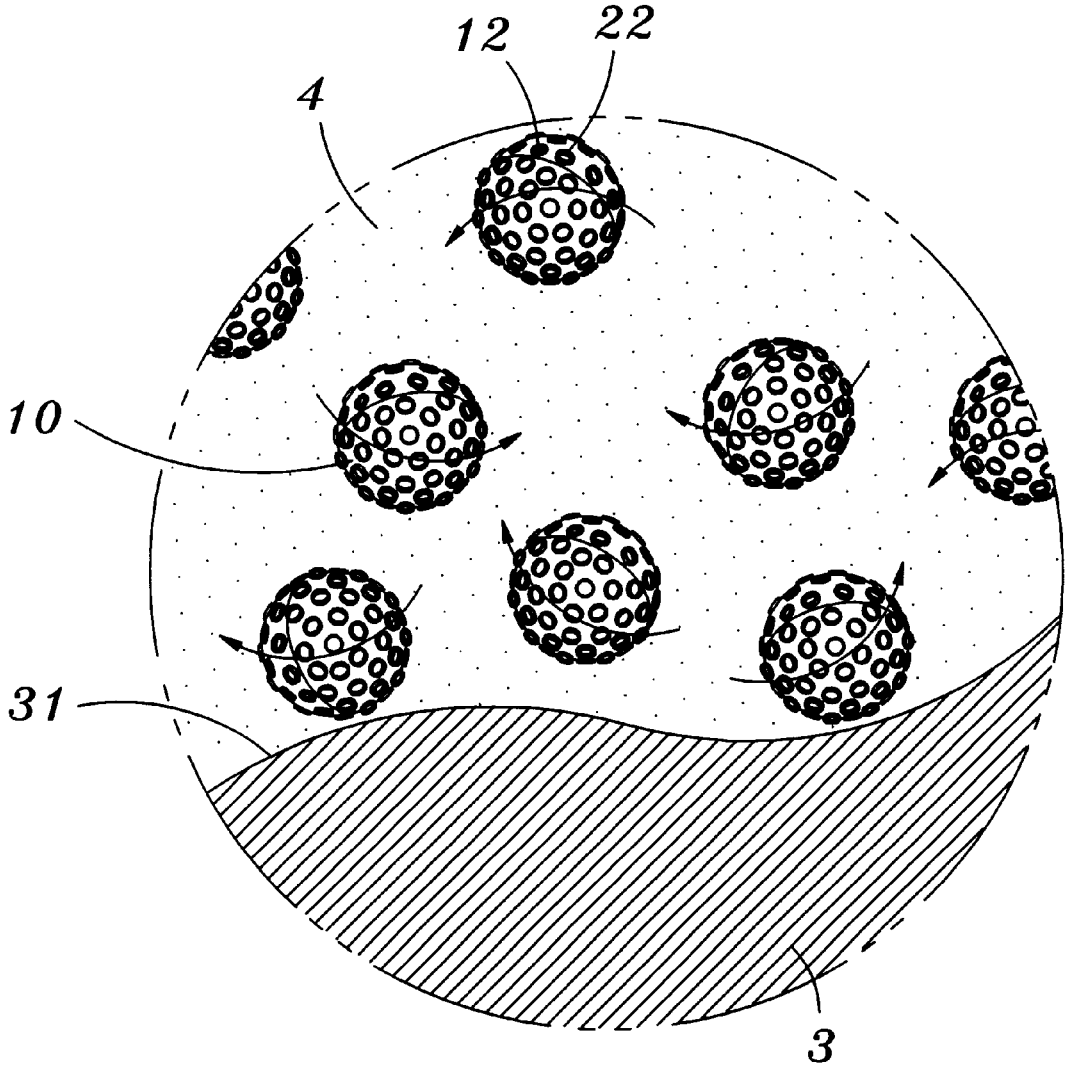
FIG. 4 is a schematic view showing a plurality of medium structures for grinding and cutting a portion of a workpiece in a vibrational grinding liquid.
Figure 5:
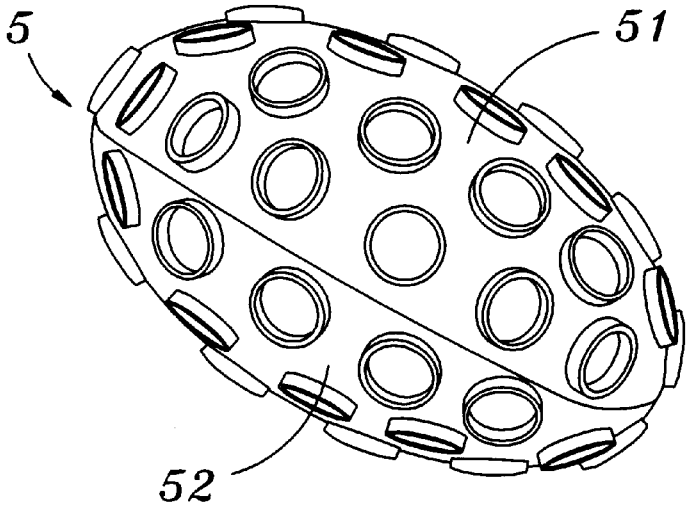
FIG. 5 is a perspective view of another preferred embodiment of medium structure of the present invention.
Figure 6:
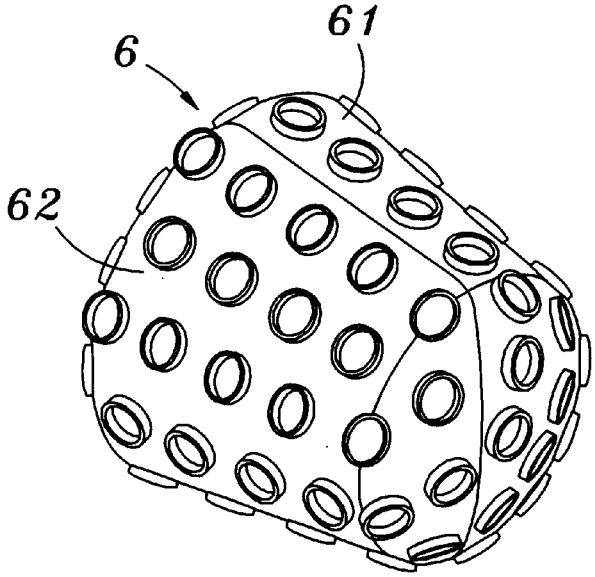
FIG. 6 is a perspective view of further preferred embodiment of medium structure of the present invention.

When in use (as shown in FIG. 4), suitable grinding material can be chosen according to the hardness and the contour of the surface 31 of a workpiece 3 to be ground. The medium structure can be comprised of two half-housings connected with each other to form a round shape (as are shown in FIG. 1 to 3), an ellipsoid (as is shown in FIG. 5) or a truncated cone (FIG. 6) beneficial for grinding and cutting operation on the workpiece desired to have a smooth contour and in the mode of three dimensional vibration and turning-over. The round medium structure 10 as shown in FIG. 4, the elliptical medium structure 5 as shown in FIG. 5 or the truncated cone shaped medium structure 6 as shown in FIG. 6 has a non accurate angular smooth curve which can prevent the curved surface 31 of the workpiece 3 from damage during the three dimensional disturbance collision and turning-over. This only allows the parts of the raised circle shaped blades 12, 22 to softly grind and cut the curved surface 31 of the workpiece 3.

When practising, one needs to select suitable amount and volume of medium structures (as shown in FIG. 4). A grinding liquid 4 is placed in a three dimensional vibrational grinding tank, wherein, each round medium structure 10 (or of other kind of curved smooth shape) is provided thereon with a plurality of smooth circle shaped raised blades 12, 22 which softly grind and cut the curved surface 31 of the workpiece 3 in the mode of three dimensional vibrational grinding and polishing, thus increasing the efficiency and quality of grinding and cutting.

One more embodiment is shown in FIG. 5, it is an elliptical medium structure again being comprised of two half-housings 51 and 52 which are engaged with each other. FIG. 6 shows a truncated cone-shaped medium structure comprised of two half-housings 61 and 62 which are also engaged with each other. Using half housings engaged with each other to form the medium structures having smooth contours for facilitating three dimensional vibration, turning-over and collision is very significant because designing of the half-housings engaged with each other to form such a medium structure is beneficial to processing of each of the half-housings 1, 2 (as shown in FIG. 2) having a plurality of smooth circle shaped blades 12, 22 integrally moulded thereon during production thereof. All the circle shaped blades 12, 22 respectively integrally formed with the half-housings 1, 2 are very thin (about 0.3 to 0.5 mm). The half-housings 1, 2 have excellent soft cutting capability, because their strength does not become weaker by such thickness. This is because the half-housings 1, 2 are both curved, and are strengthened with the circle shaped blades 12, 22 and the round through holes 11, 21. On the countrary, they have excellent strength.

Distribution of the circle shaped blades 12, 22 can be made to have a certain density according to the requirement of coordination between the curvature of the half-housings 1, 2 and the shapes of the surface 31 of the workpiece 3 to be ground in favor of three dimensional vibration and turning over and of grinding and cutting.

Figure 7:
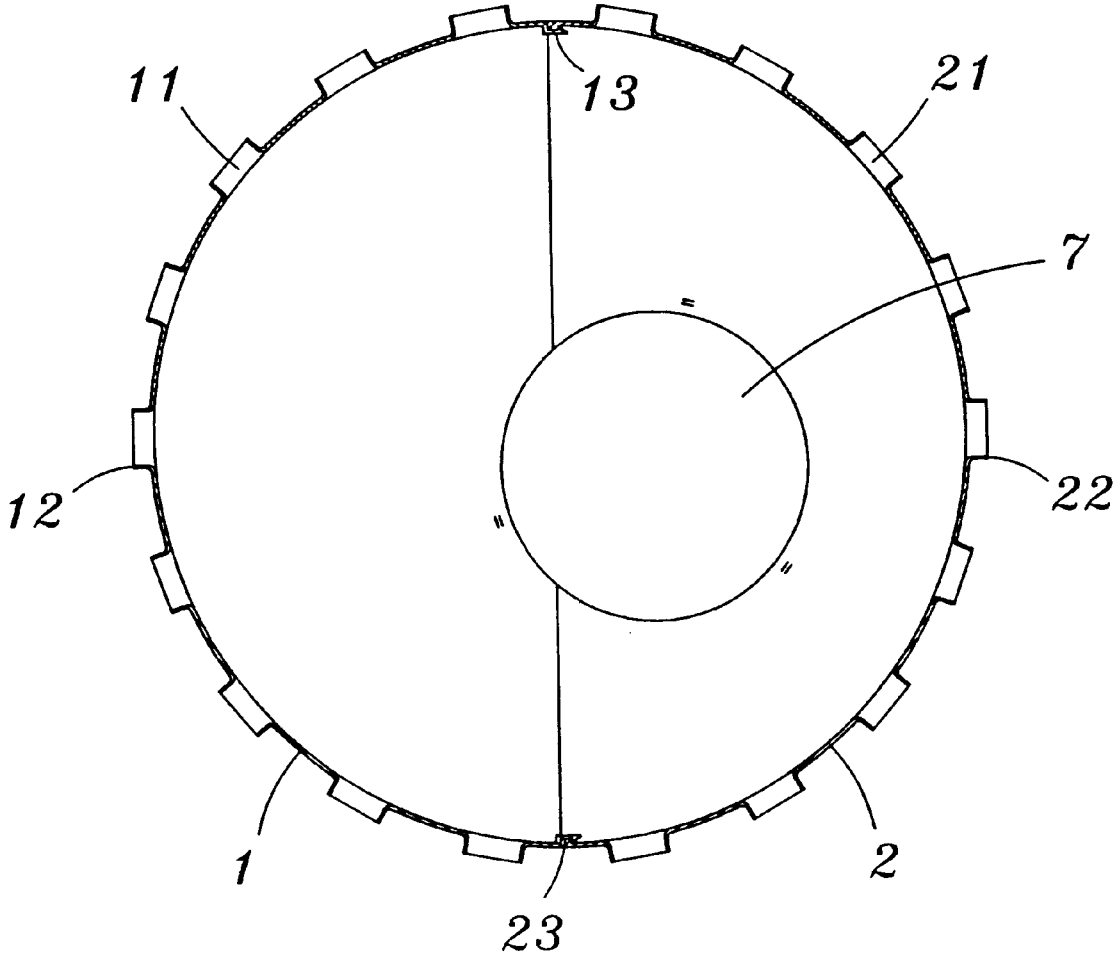
FIG. 7 is a sectional view showing that a counterweight is placed in a medium structure of the present invention.

And when in practising grinding and cutting, a counterweight 7 can be placed in the two half-housings 1, 2 (as shown in FIG. 7) during assembling of the medium structure in accordance with the specific gravity of the workpiece 3 to be ground. The counterweight 7 has a certain unit mass, it can increase the energy of grinding and cutting when the medium structure is collided with the workpiece 3 during grinding and cutting. The unit mass and the amount of the counterweight 7 to be loaded in, by all means, must be coordinated in accordance with the actual specific gravity of the workpiece 3 and the three dimensional vibration environment, so that the efficiency of grinding and cutting can be effectively increased.

In conclusion, the techniques of choosing the material according to the hardness and the material of the surface of a workpiece to be ground for manufacturing a medium structure of the present invention and control of the thickness of the cutting blades on the order of 0.3 to 0.5 mm are known techniques and are not included in the scope of the present invention. What the present invention is concerned with is the fact that any medium structure for grinding and cutting thereof shall be formed by engagement of two half-housings which each is provided with a plurality of raised circle shaped blades arranged in a radiation style. Therefore, various workpieces of different material and hardnesses and having more complicated shapes used in grinding and cutting are apparent.

Having thus described my invention, what I claim as new and desire to be secured by Letters Patent of the United States are:

1. A structure of a forceful grinding medium comprised of two half-housings and used in three dimensional vibration grinding and cutting of a surface of a workpiece in a grinding liquid, wherein;

said two half-housings both are provided with smooth curves and are engaged with each other oppositely to form said medium structure, and are integrally formed with a plurality of raised circle shaped blades arranged in a style to facilitate soft and smooth grinding and polishing on said surface of said workpiece.

2. The structure of a forceful grinding medium as in claim 1, wherein said two half-housings are engaged with each other to form a round, an ellipsoid, or a truncated cone.

3. The structure of a forceful grinding medium as in claim 1, wherein engagement of said two half-housings is achieved by providing the same amount of mortises and tenons opposite to each other on two connecting ends of said two half-housings, so that said half-housings can be press assembled easily to form said medium structure.

4. The structure of a forceful grinding medium as in claim 1 , wherein said circle shaped blades have provided at the centers thereof a plurality of through holes in communication with the interior of said two half-housings.

5. The structure of a forceful grinding medium as in claim 1, wherein a counterweight is placed in said two half-housings in accordance with the specific gravity of said workpiece to be ground.

* * * * *